US006520748B2

(12) United States Patent
Yokomachi et al.

(10) Patent No.: US 6,520,748 B2
(45) Date of Patent: Feb. 18, 2003

(54) VARIABLE DISPLACEMENT COMPRESSOR

(75) Inventors: Naoya Yokomachi, Kariya (JP); Tatsuya Koide, Kariya (JP); Kiyoshi Yagi, Kariya (JP); Takayuki Imai, Kariya (JP); Toshiro Fujii, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 12 days.

(21) Appl. No.: 09/887,315

(22) Filed: Jun. 22, 2001

(65) Prior Publication Data

US 2001/0054353 A1 Dec. 27, 2001

(30) Foreign Application Priority Data

Jun. 27, 2000 (JP) ..... 2000-192507

(51) Int. Cl.[7] ..... A61M 5/315
(52) U.S. Cl. ..... 417/222.2; 417/269
(58) Field of Search ..... 417/222.1, 222.2, 417/269, 440, 569; 92/12.2

(56) References Cited

U.S. PATENT DOCUMENTS 4,231,713 A * 11/1980 Widdowson et al. .... 417/222.1
6,099,276 A * 8/2000 Taguchi ..... 417/569
6,244,159 B1 * 6/2001 Kimura et al. ..... 92/12.2
6,280,152 B1 * 8/2001 Sugiura et al. ..... 417/269
6,283,722 B1 * 9/2001 Takenaka et al. ..... 417/222.2
6,290,468 B1 * 9/2001 Kato et al. ..... 417/222.2
6,290,470 B1 * 9/2001 Okuno et al. ..... 417/269
6,318,971 B1 * 11/2001 Ota et al. ..... 417/222.2
6,435,848 B1 * 8/2002 Minami et al. ..... 417/440
2001/0053328 A1 * 12/2001 Yamada et al. ..... 417/222.2

FOREIGN PATENT DOCUMENTS

EP 0 926 342 A2 6/1999 ..... F04B/27/10
JP 11-107914 4/1999 ..... F04B/27/10
JP 11-241681 9/1999 ..... F04B/39/00

* cited by examiner

*Primary Examiner*—Teresa Walberg
*Assistant Examiner*—Leonid M Fastovsky

(57) ABSTRACT

A suction chamber and a discharge chamber are defined in a front housing member. A crank chamber is defined between a cylinder block and a rear housing member. A drive shaft passes through the suction chamber and extends from a front end of a housing. The drive shaft is supported by the housing. A shaft sealing assembly for sealing the drive shaft is located in the suction chamber. In the cylinder block and a valve plate, a bleed passage is formed for connecting the crank chamber with the suction chamber. The bleed passage is inclined downward toward the suction chamber. The outlet of the bleed passage is above the shaft sealing assembly. In the suction chamber, a reservoir, which stores lubricating oil supplied through the bleed passage, is surrounds a lower part of the shaft sealing assembly.

10 Claims, 4 Drawing Sheets

VARIABLE DISPLACEMENT COMPRESSOR

BACKGROUND OF THE INVENTION

The present invention relates to variable displacement compressors of swash plate type provided with a single head piston for use in, for example, air-conditioning systems of vehicles or the like, particularly to variable displacement compressors having special features in the lubrication systems of shaft sealing structures provided between drive shafts (rotary shafts) for driving pistons and their housings.

In a general swash plate compressor of this type, as shown in FIG. 6, its housing is essentially composed of a front housing member 71, a cylinder block 72, and a rear housing member 73 joined and fixed to each other. A drive shaft 74, the front end of which protrudes beyond the front housing member 71, is rotatably supported by the housing through a pair of radial bearings 75 and 76 respectively provided at front and rear portions of the shaft. In the housing, a shaft sealing assembly 78 is provided at a portion nearer to the front end of the drive shaft 74 than the first radial bearing 75. The shaft sealing assembly 78 prevents the leakage of refrigerant gas from a crank chamber 77 to the atmosphere.

In such a compressor, the lubrication for sliding parts such as bearings is effected by lubricating oil, which exists as a mist in the refrigerant gas. Therefore, where the flow of the refrigerant gas is stagnant, the lubrication may become insufficient. Recently, compressors have been proposed for use in refrigerant circuits in which carbon dioxide ($CO_2$) is used in place of chlorofluorocarbon as the refrigerant, and the refrigerant may be cooled in a supercritical region beyond the critical temperature of the refrigerant. When such a refrigerant is used, the refrigerant pressure may become ten or more times higher than that of chlorofluorocarbon refrigerant. Thus, the load on the bearing portions and the shaft sealing assembly increases, and the lubrication must be highly effective.

Japanese Unexamined Patent Publication No. Hei 11-241681 discloses, as shown in FIG. 6, a structure in which a depressurization passage 79 is provided in the drive shaft 74. The inlet 79*a* of the depressurization passage 79 is open at a position closer to the front end of the drive shaft 74 than the first radial bearing 75 and corresponding to an isolation chamber 80 in which the shaft sealing assembly 78 is accommodated. The outlet 79*b* of the depressurization passage 79 is open at the rear end of the drive shaft 74. A fan 81 is firmly attached to the end portion of the drive shaft 74 on the outlet 79*b* side. The fan 81 rotates together with the drive shaft 74, and the refrigerant in the depressurization passage 79 is forced toward the outlet 79*b* side by the fan 81. The refrigerant discharged on the outlet 79*b* side then flows through gaps in the radial bearing 76 into the crank chamber 77.

Japanese Unexamined Patent Publication No- Hei 11-107914 discloses a fixed displacement type swash plate compressor that can tolerate a high axial load. In the compressor, as shown in FIG. 7, a suction chamber 82 and a discharge chamber 83 are located on the spline 74*a* side of a drive shaft 74. A second piston 86 is provided on the opposite side of the spline 74*a* from a first piston 85 and the first and second pistons sandwich a swash plate 84. In this compressor, the front housing member 71 is provided with an inlet 88 communicating with a swash plate chamber 87 and a connecting passage 89, which connects the swash plate chamber 87 with the suction chamber 82. A shaft seal 90 is located in the suction chamber 82.

In the above-mentioned compressor of Japanese Unexamined Patent Publication No. Hei 11-241681, the operation of the fan 81 creates a refrigerant flow such that some refrigerant from the crank chamber 77 flows through gaps in the first radial bearing 75 or a thrust bearing 91 into the depressurization passage 79 and then returns to the crank chamber 77 through gaps in the second radial bearing 76. Thus, the lubrication of both radial bearings 75 and 76 and the shaft sealing assembly 78 is improved. In this structure, however, since the fan 81 must be provided to make such a refrigerant flow in the depressurization passage 79, the structure is relatively complex.

In the compressor disclosed in Japanese Unexamined Patent Publication No. Hei 11-107914, the suction chamber 82 in which the shaft seal 90 is located is connected with the swash plate chamber 87 by the connecting passage 89. This connecting passage 89 is provided for conducting refrigerant to the suction chamber 82 from the swash plate chamber 87, and it is a typical passage found in fixed displacement type swash plate compressors. In variable displacement type swash plate compressors, however, since the inclination angle of the swash plate (cam plate) is changed to change the displacement by controlling the pressure in the crank chamber, in which the swash plate is located, there is no need to provide such a passage.

BRIEF SUMMARY OF THE INVENTION

The present invention has been achieved in view of the problems described above, and the object of the present invention is to provide variable displacement compressors wherein good lubrication for the shaft sealing assembly for the drive shaft can be effected by a simple structure.

To achieve the foregoing and other objectives and in accordance with the purpose of the present invention, a variable displacement compressor is provided. The compressor includes a housing, a crank chamber, a drive shaft, a cylinder bore, a single head piston, a cam plate, a shaft sealing assembly and a bleed passage. The housing includes a suction chamber and a discharge chamber. The crank chamber is defined in the housing. A first end of the drive shaft extends from a front end of the housing. The shaft is supported by the housing. The suction and discharge chambers are closer to the first end of the drive shaft than the crank chamber. The cylinder bore is located in the housing between the crank chamber and the front end of the housing. The single head piston is located in the cylinder bore. The cam plate is located in the crank chamber and connected with the piston to convert rotation of the drive shaft into reciprocation of the piston. The inclination angle of the cam plate is controlled by controlling the pressure in the crank chamber, to change the discharge displacement. The shaft sealing assembly seals the drive shaft and is located in the suction chamber. The bleed passage connects the crank chamber with the suction chamber. An outlet of the bleed passage is located above the shaft sealing assembly.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereinafter, an embodiment wherein the present invention is applied to a variable displacement type compressor for a vehicular air-conditioning system will be described with reference to FIGS. 1 to 3.

Figure 1:
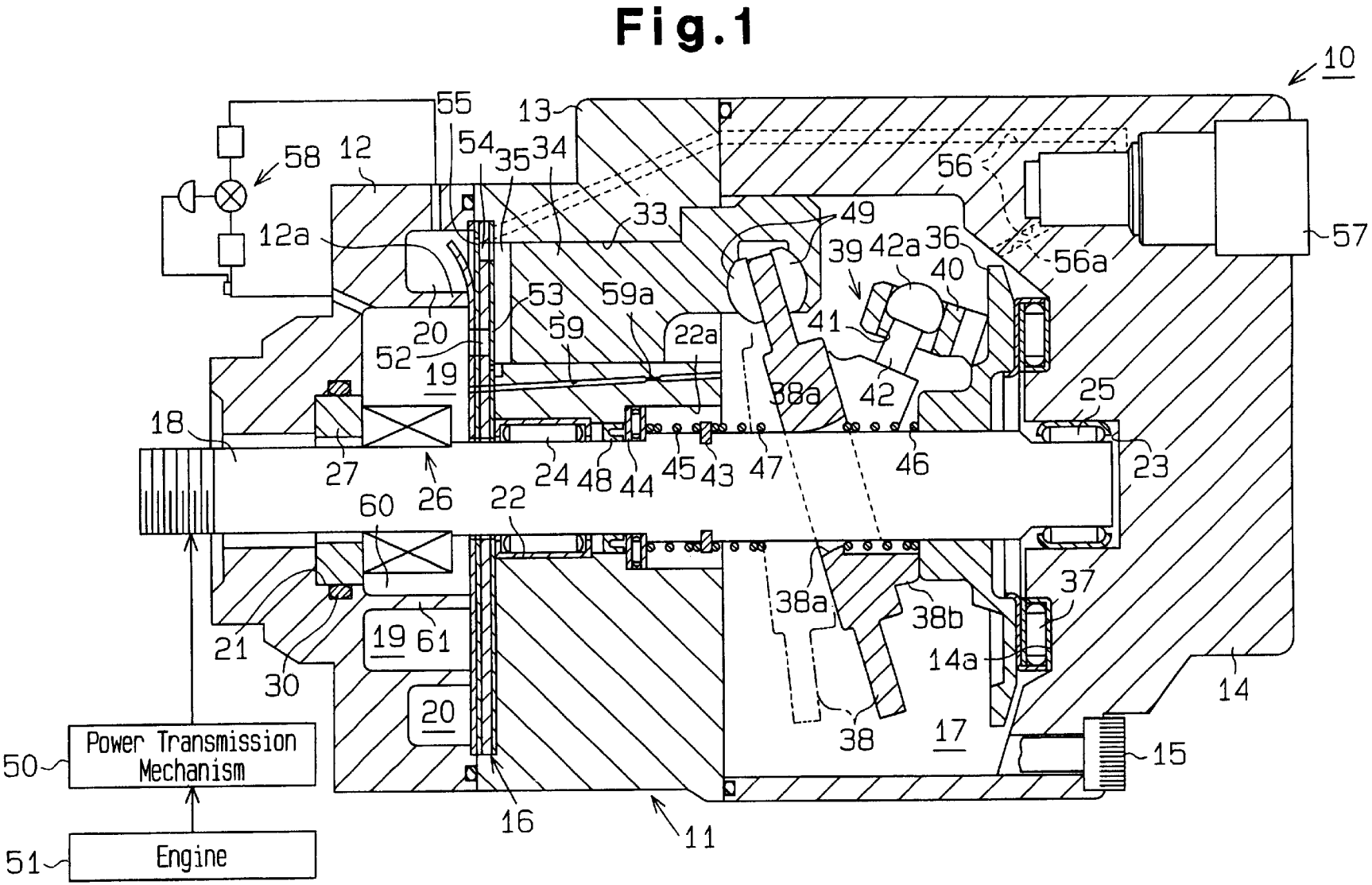
FIG. 1 is a sectional view of a compressor according to an embodiment of the present invention.

Referring to FIG. 1, a front housing member 12, a cylinder block 13, and a rear housing member 14 constituting a housing 11 of a compressor 10 are located in this order from the front end of the housing 11 (the left side of FIG. 1) and are joined and fixed to each other with a plurality of through bolts 15 (only one is shown). A valve plate 16 is located between the front housing member 12 and the cylinder block 13. A crank chamber 17 is defined by the cylinder block 13 and the rear housing member 14.

A drive shaft 18 passes through a hole formed in the valve plate 16. The front end of the drive shaft 18 protrudes beyond the front housing member 12, and the rear end is located within the crank chamber 17. In this state, the drive shaft 18 is supported by the housing 11 to rotate. In the front housing member 12, a suction chamber 19, which is also referred to as a suction pressure zone, is formed at a location near the front end of the drive shaft 18. A substantially annular discharge chamber 20 is defined by a partition 12*a* to surround the suction chamber 19. In the front housing member 12, a front recess 21 is formed in the front end of the suction chamber 19. In the cylinder block 13, a shaft hole 22 is formed to connect the crank chamber 17 with the suction chamber 19. In the rear housing member 14, a rear recess 23 is formed on the crank chamber 17 side. The rear recess 23 is part of the crank chamber 17.

The drive shaft 18 passes through the shaft hole 22, the suction chamber 19, the front recess 21, and a through hole formed in the front housing member 12. In this state, the drive shaft 18 is supported by the cylinder block 13 and the rear housing member 14. An intermediate portion of the drive shaft 18 is supported by a first radial bearing 24 provided in the shaft hole 22, and a rear end of the drive shaft 18 is supported by a second radial bearing 25, which is located in the rear recess 23.

A shaft sealing assembly 26 is provided in the suction chamber 19. As shown in FIG. 3, the shaft sealing assembly 26 includes a ring 27 firmly fitted in the front recess 21, and a slide ring 29 made of carbon. The slide ring 29 is attached to the drive shaft 18 through an O-ring 28, which rotates together with the drive shaft 18. The slide ring 29 can slide on the ring 27. The ring 27 is located around and spaced from the drive shaft 18. An O-ring 30 is located between the ring 27 and the front housing 12. A groove 29*a* is formed in the outer periphery of the slide ring 29. The shaft sealing assembly 26 further includes a support ring 31, which is rotatable together with the drive shaft 18. The support ring 31 has an engaging portion 31*a* engaging the groove 29*a* of the slide ring 29 and is provided with a spring 32 for urging the slide ring 29 toward the ring 27. A seal between the drive shaft 18 and the housing 11 (front housing member 12) is made by the O-ring 28, the slide ring 29, the ring 27, and the O-ring 30.

A plurality of cylinder bores 33 (only one of them is shown in FIG. 1) are formed in the cylinder block 13 at constant angular intervals to surround the drive shaft 18. More specifically, each cylinder bore 33 is formed at a position in the housing 11 between the crank chamber 17 and the front end of the drive shaft 18. A single head piston 34 is accommodated in each cylinder bore 33 so that the piston 34 can reciprocate. The front and rear openings of each cylinder bore 33 are shut by the valve plate 16 and the piston 34, respectively. In each cylinder bore 33, a compression chamber 35 is defined, the volume of which varies in accordance with the reciprocation of the piston 34, is defined.

In the crank chamber 17, a lug plate 36, or rotary support, is fixed to the drive shaft 18 so that the plate 36 rotates together with the drive shaft 18. The lug plate 36 transfers force to an inner wall surface 14*a* of the rear housing member 14 through a first thrust bearing 37. The inner wall surface 14*a* bears an axial load due to the compression reaction of each piston 34 and serves as a regulation surface for regulating the axial displacement of the drive shaft 18.

A swash plate 38 as a cam plate is provided in the crank chamber 17 such that the drive shaft 18 passes through a through hole 38*a* formed in the swash plate 38. A hinge mechanism 39 is provided between the lug plate 36 and the swash plate 38. The hinge mechanism 39 includes two support arms 40 (only one is shown in FIG. 1), each formed as a protrusion on a front surface portion of the lug plate 36 and each having a guide hole 41 and two guide pins 42 (only one is shown in FIG. 1) fixed to the swash plate 38. Each guide pin 42 is provided on its distal end with a spherical portion 42*a*, which engages the corresponding guide hole 41. Through the hinge connection with the lug plate 36 by the hinge mechanism 39 and the support by the drive shaft 18, the swash plate 38 can be rotated synchronously with the lug plate 36 and the drive shaft 18, and it can also tilt relative to the drive shaft 18 while sliding axially along the surface of the drive shaft 18. The lug plate 36 and the hinge mechanism 39 form inclination angle control means for the swash plate 38. The swash plate 38 has a counterweight portion 38*b* on the opposite side of the drive shaft 18 from the hinge mechanism 39.

An engaging ring (e.g., a circlip) 43 is fixed onto the drive shaft 18 at a position within a large-diameter portion 22*a* of the shaft hole 22 near the crank chamber 17. In the large-diameter portion 22*a*, a second thrust bearing 44 is accommodated through which the drive shaft 18 penetrates. Between the engaging ring 43 and the thrust bearing 44, a first coil spring 45 is wound around the drive shaft 18. This coil spring 45 urges the drive shaft 18 toward the above-mentioned regulation surface (the inner wall surface 14*a*) for regulating the axial displacement of the drive shaft 18, at least when operation of the compressor 10 is stopped.

Between the lug plate 36 and the swash plate 38, a second coil spring 46 for decreasing the inclination angle of the swash plate 38 is wound around the drive shaft 18. This coil spring 46 urges the swash plate 38 toward the cylinder block 13.

Between the swash plate 38 and the engaging ring 43, a third coil spring 47, or restoring spring is wound around the drive shaft 18. When the swash plate 38 is inclined greatly (e.g., as shown by solid lines in FIG. 1), the third coil spring 47 keeps its original length and has no effect on the swash plate 38. On the other hand, however, when the swash plate 38 shifts to decrease its inclination angle, as shown in chain lines in FIG. 1, the third coil spring 47 is compressed by the swash plate 38 and the engaging ring 43. The third coil spring 47 then urges the swash plate 38 away from the cylinder block 13 (to increase the inclination angle) with a force that is proportional to the degree of compression of the coil from the engaging ring 43 as its support base.

In the shaft hole 22, a seal ring 48 is provided between the outer circumferential surface of the drive shaft 18 and the inner surface of the cylinder block 13. The seal ring 48 prevents the gas in the crank chamber 17 from leaking through the shaft hole 22 to the suction chamber 19. The seal ring 48 is made of, for example, a rubber material or a fluororesin and has a U-shape cross section.

Each piston 34 is linked to a peripheral portion of the swash plate 38 through shoes 49. Through the shoes 49, the rotation of the swash plate 38, which is due to the rotation of the drive shaft 18, is converted into the reciprocation of the pistons 34. The material of the swash plate 38 or the shoes 49 is a ferrous metal. An aluminum-base metal or friction welding treatment for preventing seizure has been applied to the sliding surface of the swash plate 38 or the sliding surfaces of the shoes 49.

The drive shaft 18 is functionally connected with an engine 51 through a power transmission mechanism 50. The power transmission mechanism 50 can be a clutch mechanism (e.g., an electromagnetic clutch) that transmits or interrupts power using an external electric control. Alternatively, it may be a clutchless system (e.g., a combination of belt/pulley) that has no such clutch mechanism and always transmits power. In this embodiment, a clutchless type power transmission mechanism 50 is used.

In the valve plate 16, for each cylinder bore 33, a suction port 52, a suction valve 53 for opening and closing the suction port 52, a discharge port 54, and a discharge valve 55 for opening and closing the discharge port 54 are provided. The suction port 52 connects the suction chamber 19 with the corresponding cylinder bore 33, and the discharge port 54 connects the corresponding cylinder bore 33 with the discharge chamber 20.

In the cylinder block 13 and the rear housing member 14, a gas supply passage 56 is provided to connect the crank chamber 17 with the discharge chamber 20. In the middle of the supply passage 56, a control valve 57 is provided, which functions as an inclination controller for the swash plate 38. The outlet 56*a* of the supply passage 56 is open at a position above the first thrust bearing 37. The control valve 57 is a known solenoid valve, the valve chamber of which is located in the gas supply passage 56. The gas supply passage 56 is opened when the solenoid is magnetized, and the gas supply passage 56 is closed when the solenoid is demagnetized. The degree of opening of the supply passage 56 can be controlled in accordance with the level of the exciting current applied to the solenoid.

The suction chamber 19 is connected with the discharge chamber 20 through an external refrigerant circuit 58. The external refrigerant circuit 58 and the variable displacement type compressor having the above-described construction constitute a refrigerant circuit of the vehicular air-conditioning system.

In the cylinder block 13 and the valve plate 16, a bleed passage 59, which conducts refrigerant gas in the crank chamber 17 to the suction chamber 19, is provided above the drive shaft 18. The bleed passage 59 is inclined downward in the direction from the crank chamber 17 toward the suction chamber 19 so that its outlet is open at a position above the shaft sealing assembly 26. In the bleed passage 59, a restriction 59*a* is formed.

In the suction chamber 19, a reservoir 60 for storing lubricating oil supplied through the bleed passage 59 is provided under the shaft sealing assembly 26. As shown in FIG. 2, the reservoir 60 is defined by a substantially semi-circular wall 61. An end of the wall 61 is in close contact with the valve plate 16.

Next, the operation of the compressor 10 constructed as above will be described.

When the drive shaft 18 is rotated, the swash plate 38 is rotated together with the drive shaft 18 by the lug plate 36 and the hinge mechanism 39. The rotation of the swash plate 38 is converted into reciprocation of the pistons 34 through the corresponding shoes 49. As this operation continues, suction, compression, and discharge of the refrigerant are repeated in each compression chamber 35. The refrigerant supplied into the suction chamber 19 from the external refrigerant circuit 58 is drawn into a compression chamber 35 through the corresponding suction port 52, compressed by the movement of the corresponding piston 34, and then discharged into the discharge chamber 20 through the corresponding discharge port 54. The refrigerant discharged into the discharge chamber 20 is then returned to the external refrigerant circuit 58 through a discharge passage.

An unillustrated controller controls the degree of opening the control valve 57, i.e., the degree of opening the gas supply passage 56, in accordance with the cooling load, to change the degree of communication of the discharge chamber 20 with the crank chamber 17.

When the cooling load is heavy, the degree of opening the supply passage 56 is decreased to decrease the flow rate of the refrigerant gas supplied from the discharge chamber 20 into the crank chamber 17. As the flow rate of the refrigerant gas supplied into the crank chamber 17 is decreased, the pressure in the crank chamber 17 is lowered gradually due to escape of the refrigerant gas through the bleed passage 59 into the suction chamber 19. As a result, the difference in pressure between the crank chamber 17 and the cylinder bores 33 through the pistons 34 becomes small, and the swash plate 38 is shifted such that its inclination angle increases. Thus, the stroke of each piston 34 is increased, which increases the discharge displacement.

Inversely, when the cooling load is light, the degree of opening the supply passage 56 is increased to increase the flow rate of the refrigerant gas supplied from the discharge chamber 20 into the crank chamber 17. When the flow rate of the refrigerant gas supplied into the crank chamber 17 exceeds the escape rate of the refrigerant gas through the bleed passage 59 into the suction chamber 19, the pressure in the crank chamber 17 rises gradually. As a result, the difference in pressure between the crank chamber 17 and the cylinder bores 33 through the pistons 34 becomes large, so that the swash plate 38 is shifted to decrease its inclination angle. Thus, the stroke of each piston 34 is decreased to decrease the discharge displacement.

When each piston 34 compresses the refrigerant gas, the compression reaction force F1 onto the piston 34 acts on the drive shaft 18 through the shoe 49, the hinge mechanism 39, and the lug plate 36 so that the piston 34 is moved toward the rear housing member 14. Also, the pressure Pc in the crank chamber 17 acts on the rear end of the drive shaft 18 in the direction opposite to the compression reaction force, and the atmospheric pressure Pa, which is lower than the pressure Pc in the crank chamber 17, acts on the front end of the drive shaft 18 in the same direction as the compression reaction force. Therefore, the force F2=(Pc−Pa)·S, which is obtained by multiplying the difference of the pressure Pc in the crank chamber 17 from the atmospheric pressure Pa by the sectional area S of the portion of the drive shaft 18 in the crank chamber 17 corresponding to the seal ring 48, acts on the drive shaft 18 in the direction opposite to the compression reaction force. Conventionally, such a force F2 acts on the drive shaft 18 in the same direction as the compression reaction force F1. In the present invention, however, the force F2 acts on the drive shaft 18 in the direction opposite to the compression reaction force F1. Thus, less power is required to drive the drive shaft 18.

In a clutchless type compressor system, even when the operation of the air-conditioning system is stopped, the rotation of the engine 51 is transmitted to the drive shaft 18. At this time, although the inclination angle of the swash plate 38 is minimized, compression is performed by each piston 34 and the compression reaction force acts on the drive shaft 18. However, as described above, since a force based on the pressure difference between the crank pressure Pc and the atmospheric pressure Pa acts on the drive shaft 18 in the direction opposite to the compression reaction force, power consumption is reduced when the compressor 10 is not being used for air-conditioning.

The suction chamber 19, in which the shaft sealing assembly 26 is accommodated, communicates with the crank chamber 17 through the bleed passage 59, and a flow of refrigerant from the crank chamber 17 to the suction chamber 19 always exits due to the pressure difference between the crank chamber 17 and the suction chamber 19. Thus, refrigerant gas constantly flows into the suction chamber 19 where the shaft sealing assembly 26 is located. Therefore, the shaft sealing assembly 26 is well lubricated.

While the refrigerant gas flows in the bleed passage 59, lubricating oil, which exists as a mist in the refrigerant gas may adhere to the wall surface of the bleed passage 59. Even when the lubricating oil enters the suction chamber 19 in such a state, since the lubricating oil can be stored in the reservoir 60 below the lower part of the shaft sealing assembly 26, the lower part of the shaft sealing assembly 26 can contact the lubricating oil to provide good lubrication.

This embodiment has the following effects.

(1) A suction pressure zone in which the shaft sealing assembly 26 for the drive shaft 18 is located is provided in the housing 11, and a bleed passage 59 connecting the suction pressure zone with the crank chamber 17 is provided so that the outlet of the bleed passage 59 is open above the shaft sealing assembly 26. Therefore, refrigerant gas from the crank chamber 17 flowing to the suction pressure zone contacts the shaft sealing assembly 26 from above. This provides good lubrication for the shaft sealing assembly 26 by the lubricating oil contained in the refrigerant gas.

(2) Since the suction chamber 19 serves as the above-mentioned suction pressure zone, no separate suction pressure zone is required. This simplifies the construction. Also, since the temperature of the atmosphere around the shaft sealing assembly 26 is lower than the temperature in the crank chamber 17, the durability of the shaft sealing assembly 26 is improved.

(3) In the suction chamber 19, a reservoir 60 for storing the lubricating oil supplied through the bleed passage 59 is provided below the lower part of the shaft sealing assembly 26. Therefore, even when atomized lubricating oil in the refrigerant gas adheres to the wall of the bleed passage 59 while the refrigerant gas flows in the bleed passage 59 and the lubricating oil enters the suction chamber 19 in liquid form, the lubricating oil is stored in the reservoir 60 without flowing to the lower part of the suction chamber 19. The lower part of the shaft sealing assembly 26 thus contacts the lubricating oil, which results in good lubrication. Such a clutchless type compressor 10 may be operated for a long time in a state such that the difference in pressure between the crank chamber 17 and the suction chamber 19 is small when the compressor 10 is not being used, such as in winter. Even in such a case, good lubrication for the shaft sealing assembly 26 is performed by the lubricating oil stored in the reservoir 60.

(4) The bleed passage 59 is inclined downward from the crank chamber 17 toward the suction pressure zone. Therefore, lubricating oil that has adhered to the wall of the bleed passage 59 can readily enter the suction pressure zone, which results in good lubrication of the shaft sealing assembly 26.

(5) The suction and discharge chambers 19 and 20 are located near the front end (the protruding end side beyond the housing 11) of the drive shaft 18. As a result, the pressure in the crank chamber 17 acts on the rear end of the drive shaft 18, in the direction opposite to the compression reaction force acting on the drive shaft 18. Therefore, the power for driving the drive shaft 18 is reduced considerably in comparison with conventional compressors, in which these forces act in the same direction. Also, the durability of the thrust bearing 37 is improved. These effects are more significant when $CO_2$, rather than chlorofluorocarbon, is used as the refrigerant.

(6) The suction and discharge chambers 19 and 20 are located near the protruding end of the drive shaft 18, and the shaft sealing assembly 26 is located within the suction pressure zone (the suction chamber 19). Therefore, in comparison with conventional compressors, in which such a shaft sealing assembly must withstand the pressure difference between the pressure in the crank chamber 17, which is higher than that in the suction pressure zone, and the atmospheric pressure, the life of the shaft sealing assembly 26 is extended and the reliability of the shaft seal is improved. In particular, this is more effective when using, for example, $CO_2$ as the refrigerant, since the pressure in the crank chamber 17 is considerably higher than when using chlorofluorocarbon.

The present invention is not limited to the above-described embodiment, and the present invention may include the following modifications for example.

Figure 2:
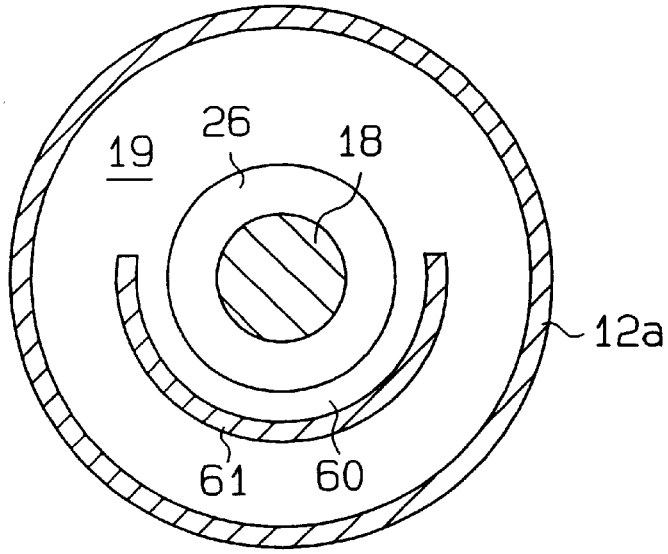
FIG. 2 is a schematic partial sectional view illustrating the relation between a shaft sealing assembly and a reservoir.
Figure 3:
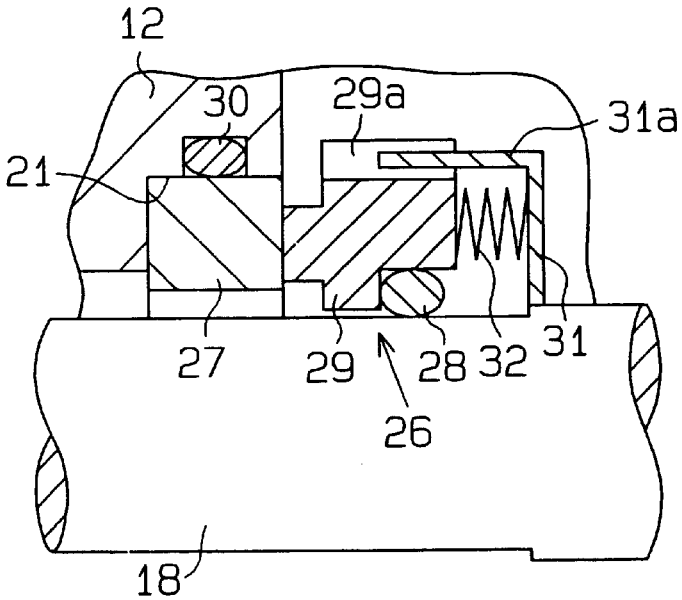
FIG. 3 is a schematic partial sectional view illustrating the upper half of the shaft sealing assembly.

The cross section of the reservoir 60 is not limited to such a semicircular shape illustrated in FIG. 2. The reservoir 60 can have any shape that permits storage of the lubricating oil that enters the suction chamber 19 through the bleed passage 59 as liquid such that the lower part of the shaft sealing assembly 26 contacts the lubricating oil stored in the reservoir 60.

Figure 4:
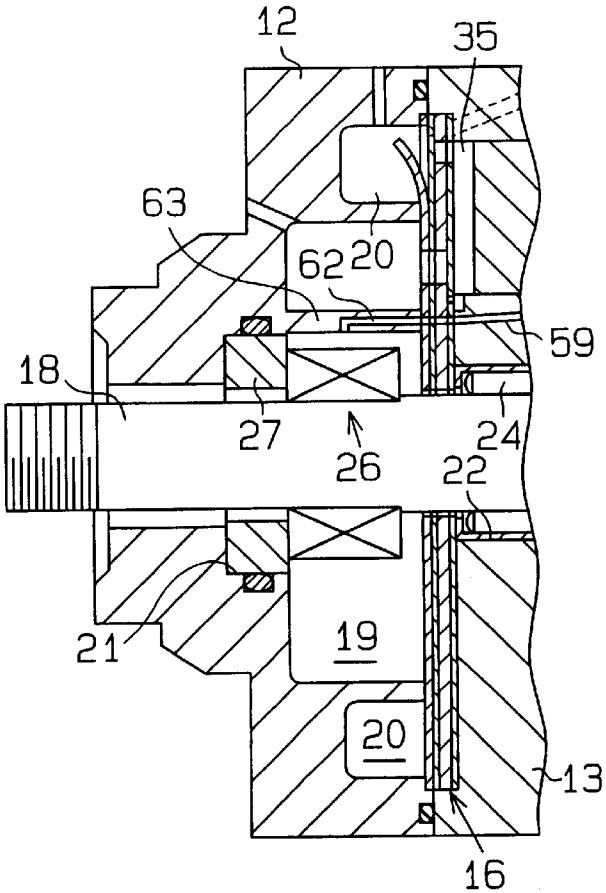
FIG. 4 is a partial sectional view of another embodiment of the present invention.
Figure 6:
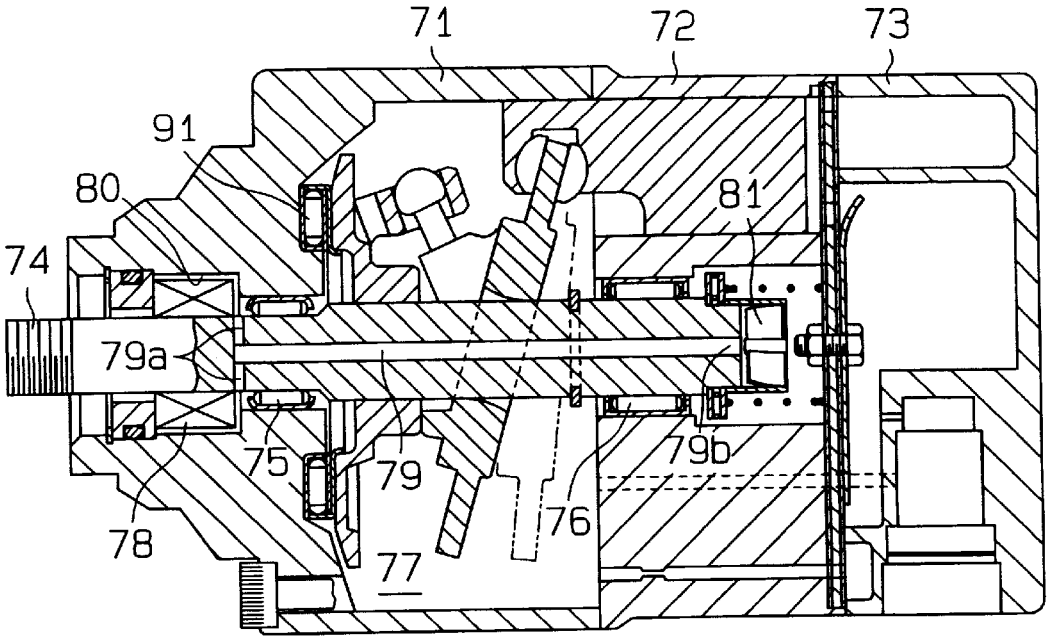
Fig.6(Prior Art)
FIG. 6 is a sectional view of a variable displacement compressor according to a prior art.
Figure 7:
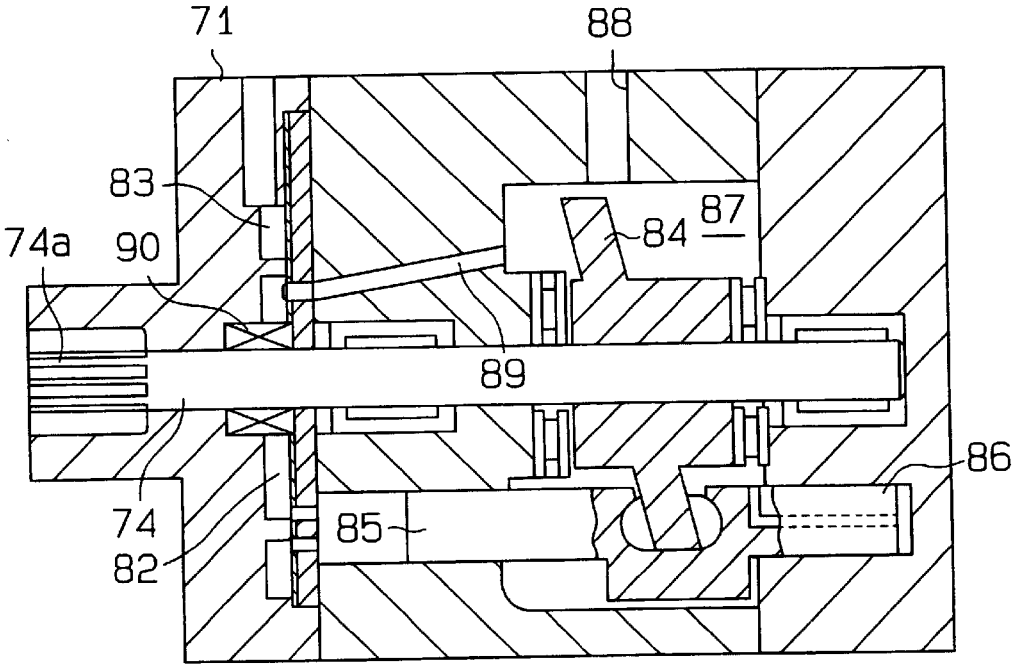
Fig.7(Prior Art)
FIG. 7 is a sectional view of a fixed displacement type swash plate compressor according to another prior art.

The reservoir 60 may be omitted. If the reservoir 60 is omitted, as shown in FIG. 4, a passage 62 communicating with the bleed passage 59 is preferably provided in the suction pressure zone so that the refrigerant gas supplied through the bleed passage 59 is delivered to the upper part of the shaft sealing assembly 26. In the structure shown in FIG. 4, the front housing member 12 is provided with a projection 63 extending over the shaft sealing assembly 26 along the drive shaft 18 up to the valve plate 16, and a through hole is formed in the projection 63 to serve as the above-mentioned passage 62. In this structure, even if some of the lubricating oil has adhered to the wall surface of the bleed passage 59, and liquid lubricant flows into the suction pressure zone, the liquid is guided to the passage 62 to drop directly onto the shaft sealing assembly 26. Thus, good lubrication for the shaft sealing assembly 26 is performed even without the reservoir 60.

For introducing such a liquid part of the lubricating oil onto the upper part of the shaft sealing assembly 26, in place of the through hole as described above, a guide member (e.g., a gutter) extending from a position immediately below the outlet of the bleed passage 59 to a position above the shaft sealing assembly 26 may be provided on the valve plate 16. The guide member can be formed as part of the valve plate 16. In this case, since the liquid part of the lubricating oil is guided by the guide member and then drops directly onto the shaft sealing assembly 26, substantially the same effect as described above is obtained. Also, this variation is simpler than the above-mentioned structure because this variation requires no through hole.

The above-described passage 62 may be used together with the reservoir 60.

Figure 5:
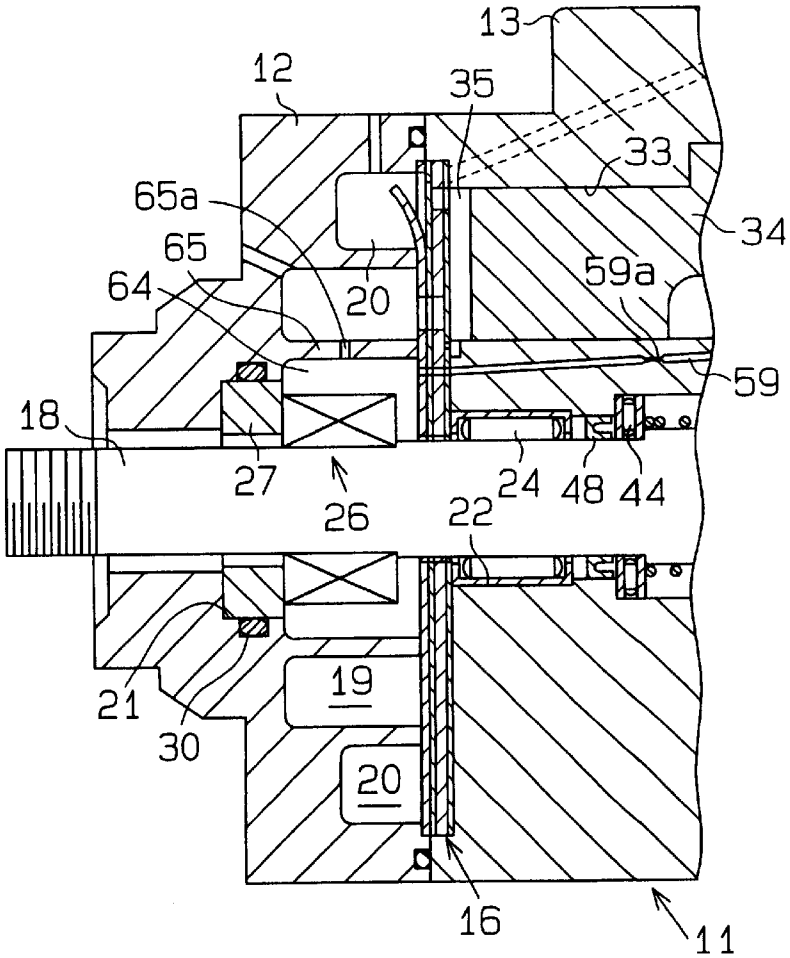
FIG. 5 is a partial sectional view of another embodiment of the present invention.

The shaft sealing assembly 26 need not always be located in the suction chamber 19. For example, as shown in FIG. 5, a chamber 64 serving as a suction pressure zone in which the shaft sealing assembly 26 is located may be defined by a partition wall 65 inside an annular suction chamber 19. The chamber 64 communicates with the suction chamber 19 through a hole 65*a*. Also in this case, the effects (1), and (4) to (6) of the above-described embodiment can be obtained.

In case that a suction pressure zone for accommodating the shaft sealing assembly 26 is provided independently of a suction chamber 19, the suction chamber 19 may be located outside the discharge chamber 20.

As shown in FIG. 5, the bleed passage 59 may be inclined downward in the direction toward the suction pressure zone a location corresponding to the cylinder block 13 and parallel to the drive shaft 18 at a location corresponding to the valve plate 16.

The bleed passage 59 need not always be inclined downward in the direction toward the suction pressure zone. It may be horizontal.

The bleed passage 59 may have a constant diameter with no restriction 59*a*. However, provision of such restriction 59*a* makes it easy to restrict the flow rate of the refrigerant gas flowing through the bleed passage 59 into the suction pressure zone to a predetermined value or less.

Instead of the above-described construction, in which the cam plate (the swash plate 38) is rotated together with the drive shaft 18, the present invention can be applied also to wobble type compressors, in which the cam plate pivots and rotates relative to the drive shaft.

The shaft sealing assembly 26 is not limited to mechanical seals. It may alternatively be a lip type seal in which a circumferential surface of the drive shaft 18 forms a sliding seal surface. In this case, the contact surface of the seal is preferably provided with a helical groove for guiding lubricating oil back to the interior of the compressor.

The control valve 57 in the present invention for controlling the degree of opening the gas supply passage 56 is not necessarily a magnetic control valve. For example, also usable are so-called internal control valves, such as the control valve disclosed in Japanese Unexamined Patent Publication No. Hei 6-123281, which includes a diaphragm displaced by the suction pressure and a valve system for controlling the degree of opening of a control passage in accordance with the displacement of the diaphragm. In clutchless type compressors, however, it is preferable to use magnetic valves, which are externally controllable.

The drive source is not limited to the engine 51. An electric motor may drive the compressor. Compressors of this type can be used in electric vehicles.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing, which includes a suction chamber and a discharge chamber;

a crank chamber, which is defined in the housing;

a drive shaft, a first end of which extends from a front end of the housing, wherein the shaft is supported by the housing, and wherein the suction and discharge chambers are closer to the first end of the drive shaft than the crank chamber;

a cylinder bore, which is located in the housing between the crank chamber and the front end of the housing;

a single head piston, which is located in the cylinder bore;

a cam plate located in the crank chamber and connected with the piston to convert rotation of the drive shaft into reciprocation of the piston, wherein the inclination angle of the cam plate is controlled by controlling the pressure in the crank chamber, to change the discharge displacement;

a shaft sealing assembly for sealing the drive shaft, wherein the shaft sealing assembly is located in the suction chamber; and a bleed passage for connecting the crank chamber with the suction chamber, wherein an outlet of the bleed passage is located above the shaft sealing assembly.

2. The variable displacement compressor according to claim 1, wherein a chamber for accommodating the shaft sealing assembly is defined in the suction chamber.

3. The variable displacement compressor according to claim 2, wherein a reservoir for storing lubricating oil from the bleed passage is provided in the suction chamber below a lower part of the shaft sealing assembly, wherein the reservoir is in close proximity to the shaft sealing assembly so that oil in the reservoir can contact the shaft sealing assembly.

4. The variable displacement compressor according to claim 1, wherein the bleed passage is inclined downward from the crank chamber toward the suction chamber.

5. The variable displacement compressor according to claim 1, wherein the housing includes a front housing member, a rear housing member and a cylinder block, wherein the bleed passage is formed in the cylinder block, and wherein the front housing member has a passage that delivers liquid lubricating oil from the bleed passage to the shaft sealing assembly.

6. The variable displacement compressor according to claim 5, wherein the passage extends from the outlet of the bleed passage to a position above the shaft sealing assembly.

7. A variable displacement compressor comprising:

a housing, which includes a front housing member, a rear housing member and a cylinder block, wherein the housing includes a suction chamber and a discharge chamber;

a crank chamber, which is defined between the rear housing member and the cylinder block;

a drive shaft, a first end of which extends from a front end of the housing, wherein the shaft is supported by the housing, and wherein the suction and discharge chambers are closer to the first end of the drive shaft than the crank chamber;

a cylinder bore, which is located in the cylinder block between the crank chamber and the front end of the housing;

a single head piston, which is located in the cylinder bore;

a cam plate located in the crank chamber and connected with the piston to convert rotation of the drive shaft into reciprocation of the piston, wherein the inclination angle of the cam plate is controlled by controlling the pressure in the crank chamber, to change the discharge displacement;

a shaft sealing assembly for sealing the drive shaft, wherein the shaft sealing assembly is located in the suction chamber; and a bleed passage for connecting the crank chamber with the suction chamber, wherein an outlet of the bleed passage is located above the shaft sealing assembly.

8. The variable displacement compressor according to claim 7, wherein a chamber for accommodating the shaft sealing assembly is defined in the suction chamber.

9. The variable displacement compressor according to claim 8, wherein a reservoir for storing lubricating oil from the bleed passage is provided in the suction chamber below a lower part of the shaft sealing assembly, wherein the reservoir is in close proximity to the shaft sealing assembly so that oil in the reservoir can contact the shaft sealing assembly.

10. The variable displacement compressor according to claim 7, wherein the bleed passage is inclined downward from the crank chamber toward the suction chamber.

* * * * *